US006592391B1

(12) United States Patent
Wu

(10) Patent No.: US 6,592,391 B1
(45) Date of Patent: Jul. 15, 2003

(54) ELECTRICAL CONNECTOR HAVING A LOCKER FOR ENABLING THE CONNECTOR TO HAVE A RELIABLE CONNECTION WITH A MATED CONNECTOR

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/244,890

(22) Filed: Sep. 16, 2002

Related U.S. Application Data

(63) Continuation-in-part of application No. 10/209,553, filed on Jul. 30, 2002.

(51) Int. Cl.[7] ..... H01R 13/627
(52) U.S. Cl. ..... 439/352; 439/357
(58) Field of Search ..... 439/352, 350, 439/353, 354–358, 372, 607, 610

(56) References Cited

U.S. PATENT DOCUMENTS

| | | | | |
|---|---|---|---|---|
| 5,564,939 A | * | 10/1996 | Maitani et al. | 439/352 |
| 5,634,809 A | * | 6/1997 | Hirai | 439/352 |
| 5,951,316 A | * | 9/1999 | Kawano et al. | 439/352 |
| 6,394,842 B1 | * | 5/2002 | Sakurai et al. | 439/607 |
| 6,457,987 B1 | * | 10/2002 | Yeh | 439/352 |

* cited by examiner

*Primary Examiner*—Hien Vu
(74) *Attorney, Agent, or Firm*—Wei Te Chung

(57) ABSTRACT

An electrical connector comprises a base (10) and a cover (20) assembled together. A pull tab (80) assembled to the base and has a pair of arms (82). Each arm has a latch releasing portion (83) at a free end thereof. A pair of latch springs (70) is mounted on the base and cooperates with the latch releasing portions. A metal locker (90) has a pressing portion (91) and a pair of barbs (942). The locker connects with the pull tab and the barbs abut against the base to secure the pull tab on the base. When the pressing portion is pressed upwardly, the barbs disengage with the base and the pull tab can be pulled rearwards.

5 Claims, 10 Drawing Sheets

ELECTRICAL CONNECTOR HAVING A LOCKER FOR ENABLING THE CONNECTOR TO HAVE A RELIABLE CONNECTION WITH A MATED CONNECTOR

CROSS-REFERENCE TO RELATED APPLICATION

This application is a continuation-in-part (C-I-P) application of patent application Ser. No. 10/209,553, entitled "ELECTRICAL CONNECTOR HAVING A LATCH MECHANISM", invented by Jerry Wu, filed on Jul. 30, 2002, and assigned to the assignee of the present invention. The disclosure of the '533 parent application is wholly incorporated herein by reference.

BACKGROUND OF THE INVENTION

1. Field of the Invention

The present invention relates to an electrical connector, and particularly to an electrical connector having a locker by which the electrical connector can have a reliably secure connection with a mated complementary connector.

2. Description of Prior Art

Referring to U.S. Pat. No. 5,564,939, a conventional electrical connector disclosed has a pair of latch springs 22 and 22A respectively attached on opposite sides of a housing 21 of the connector. An operating member 23 has a pair of latch releasing cams 23-4 located below angled portions 22-4 of the latch springs 22, 22A. When an operator pulls a pull tab 23-8 of the operating member 23 backwardly, the latch releasing cams 23-4 exert outward forces on the angled portions 22-4 and U-shaped claws 22-1 slip out to release a mated complementary connector. When the electrical connector is electrically connected with the mate complementary connector and the pull tab 23-8 is carelessly pulled to move rearwards, the electrical connection between the two connectors may be broken off. To overcome this problem, an electrical connector is needed which has means for preventing the pull tab to be carelessly pulled to move rearwards.

SUMMARY OF THE INVENTION

It is an objective of the present invention to provide an electrical connector having a locker assembled therein. The locker prevents a latch device of the electrical connector from being carelessly wrongly manipulated when the locker is at a close position. The latch device secures the electrical connector and a complementary connector together. Thus, a reliably secure connection between the two connectors can be achieved, without the fear that the latch device may be carelessly activated to cause a separation of the two connected connectors.

In order to achieve the above-mentioned objective, an electrical connector in accordance with the present invention comprises a base and a cover assembled together. A pull tab assembled to the base has a pair of arms. Each arm has a latch releasing portion at a free end thereof. A pair of latch springs is mounted on the base and cooperates with the pull tab. The latch releasing portions driveablly connect with the latch springs, whereby the latch releasing portions moves the latch springs outwardly. A locker has a pressing portion and a pair of locking portions. The locker connects with the pull tab and the locking portions abut against the base to secure the pull tab on the base in a front-to-back direction. When the pressing portion is pressed upwardly, the locking portions disengage from the base and the pull tab can be pulled rearwards. The latch releasing portions pull the latch springs outwardly to separate a mated complementary connector therefrom.

Other objects, advantages and novel features of the invention will become more apparent from the following detailed description when taken in conjunction with the accompanying drawings.

DETAILED DESCRIPTION OF THE INVENTION

Figure 1:
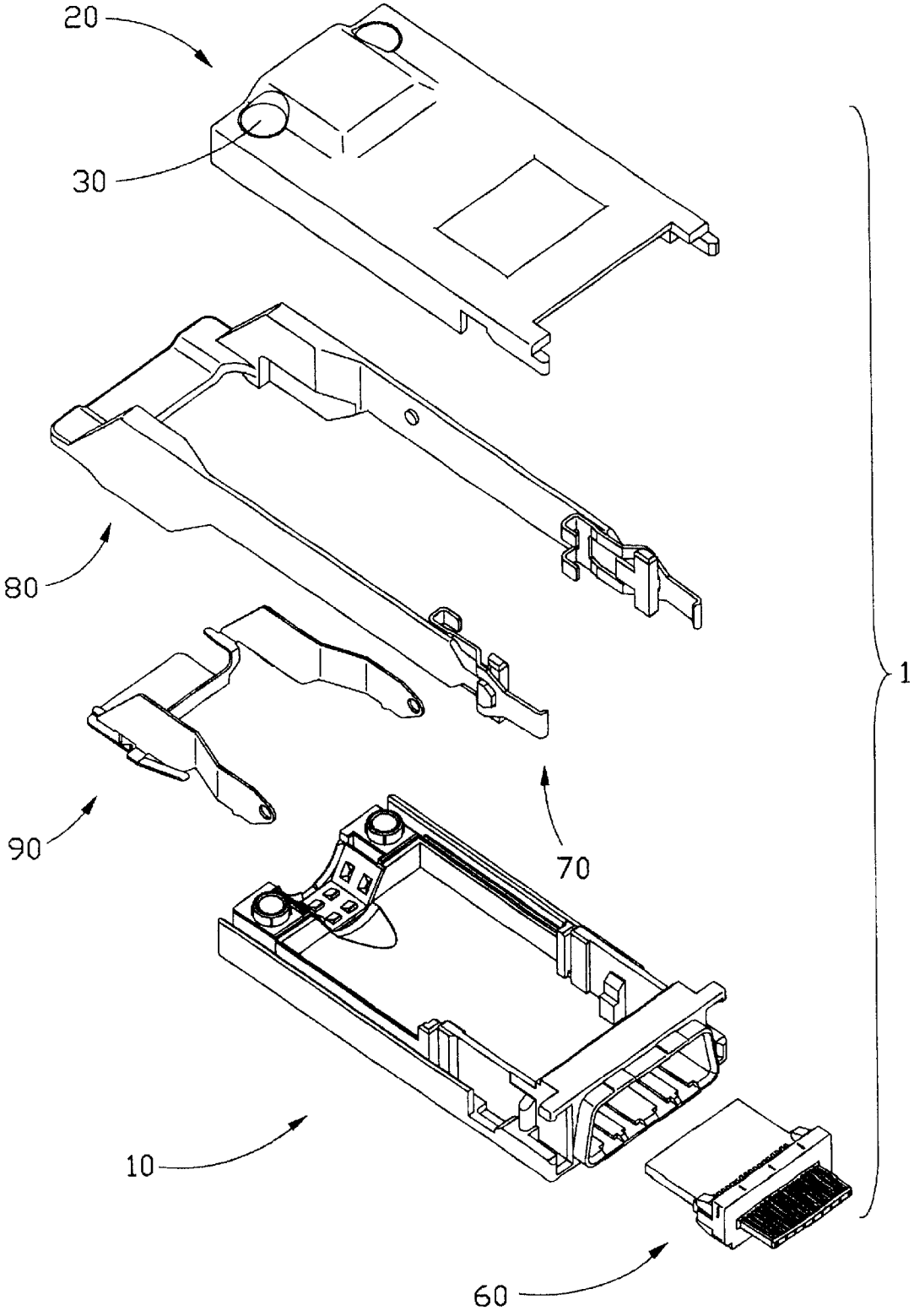
FIG. 1 is an exploded perspective view of an electrical connector in accordance with the present invention.

Referring to FIG. 1, an electrical connector 1 for a cable end use in accordance with the present invention comprises a base 10, a cover 20 for being assembled to the base 10, a pair of screws 30 for securing the cover 20 on the base 10, a connector subassembly 60, a pair of latch springs 70, a pull tab 80 and a locker 90.

Figure 2:
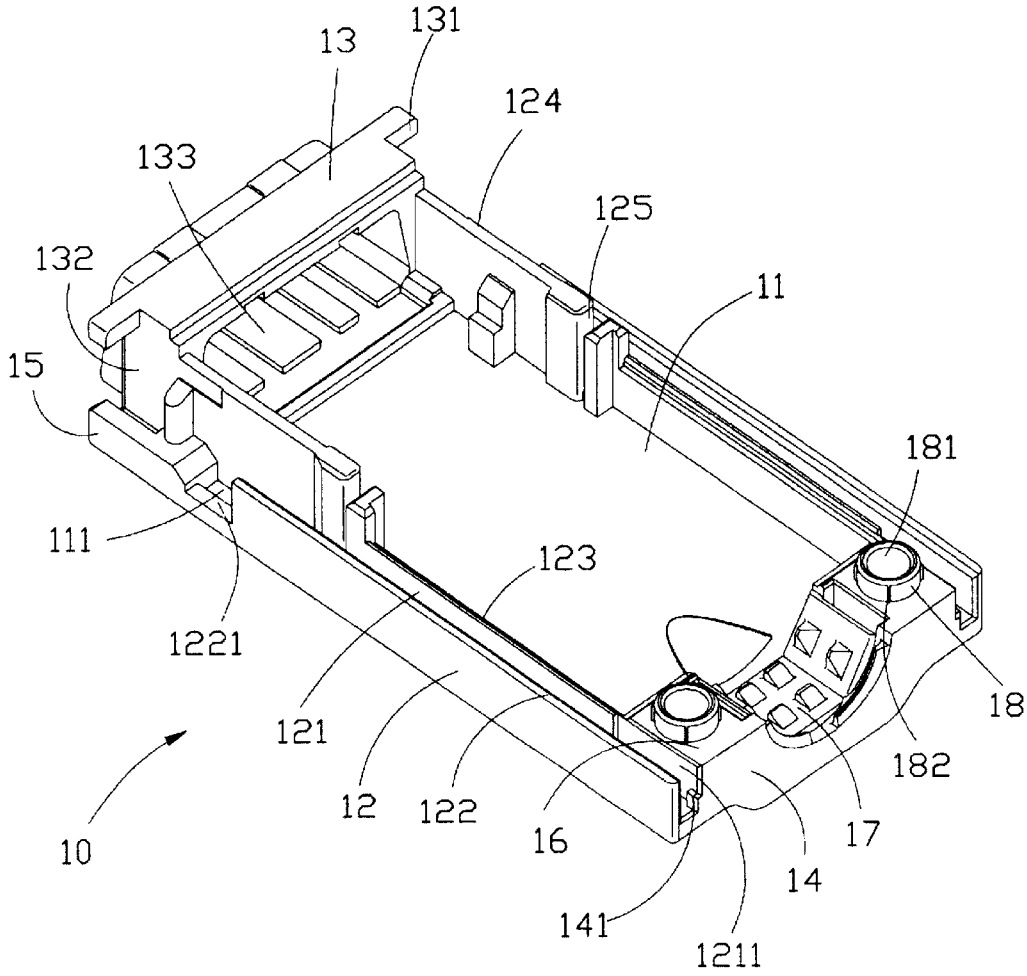
FIG. 2 is an enlarged perspective view of a base shown in FIG. 1.

The base 10 and the cover 20 commonly defining an enclosure to enclose the connector subassembly 60, are formed by die casting metallic material, for example, aluminum alloy. Referring to FIG. 2, the base 10 comprises a base plate 11 and a pair of sidewalls 12 upwardly extending from opposite lateral sides of the base plate 11. Each sidewall 12 defines an elongated channel 121 from a rear portion 14 toward a front end 15 of the base 10 and through a top engaging face 16 thereof. Each sidewall 12 is divided into an outer wall 122 and an inner wall 123 by the channel 121. The channels 121 each have a widened portion 1211 at the rear portion 14. A pair of stoppers 141 projects from the rear portion 14 into the widened portions 1211 of the channels 121, respectively. The inner walls 123 each have a higher shoulder portion 124 adjacent to the front end 15. The shoulder portions 124 each define a vertical slit 125 at a rear end thereof. The outer walls 122 each define a cutout 1221 adjacent to the front end 15. The base plate 11 defines a pair of grooves 111 between the shoulder portions 124 of the cutouts 1221. A mating frame 13 is formed at the front end 15 of the base 10. The mating frame 13 defines an opening 133 through the front end 15. A pair of engaging ears 131 is formed on opposite sides of a top of the mating frame 13 and extends laterally. A pair of engaging spaces 132 is defined in opposite sides of the mating frame 13 and between the engaging ears 131 and the base plate 11. The base 10 has a first substantially semicircular opening 17 at the rear portion 14. A pair of posts 18 protrudes upwardly from the engaging face 16, located respectively beside opposite lateral sides of the first opening 17. Each post 18 defines a screw hole 181 therein and has four ribs 182 on a circumferential periphery thereof.

Figure 3:
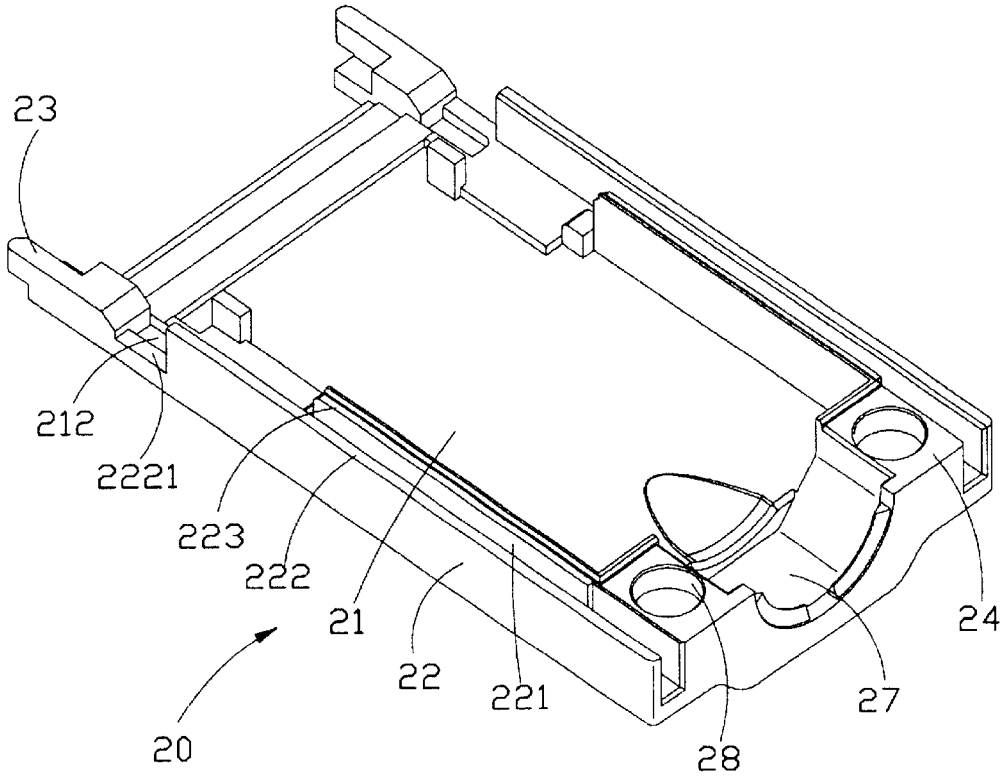
FIG. 3 is an enlarged perspective view of a cover shown in FIG. 1 from a bottom aspect.

Referring to FIG. 3, the cover 20 comprises a cover plate 21 and a pair of sidewalls 22 downwardly extending from opposite lateral sides of the cover plate 21. Each sidewall 22 defines an elongated channel 221 corresponding to one of the channels 121 of the base 10. Each sidewall 22 is divided into an outer wall 222 and an inner wall 223 by the channel 221. A pair of grooves 212, corresponding to the grooves 111 in the base 10, is defined in the cover plate 21 in inner sides of a pair of cutouts 2221 which is corresponding to the cutouts 1221 in the base 10. A pair of projections 23 extends forwardly from opposite sides of a front end of the cover plate 21. A semicircular second opening 27 is defined in a rear end 24 of the cover plate 21 corresponding to the first opening 17 of the base 10. A pair of holes 28 is defined beside opposite lateral sides of the second opening 27. Each hole 28 has a diameter generally equal to an outer diameter of each of the posts 18.

Figure 4:
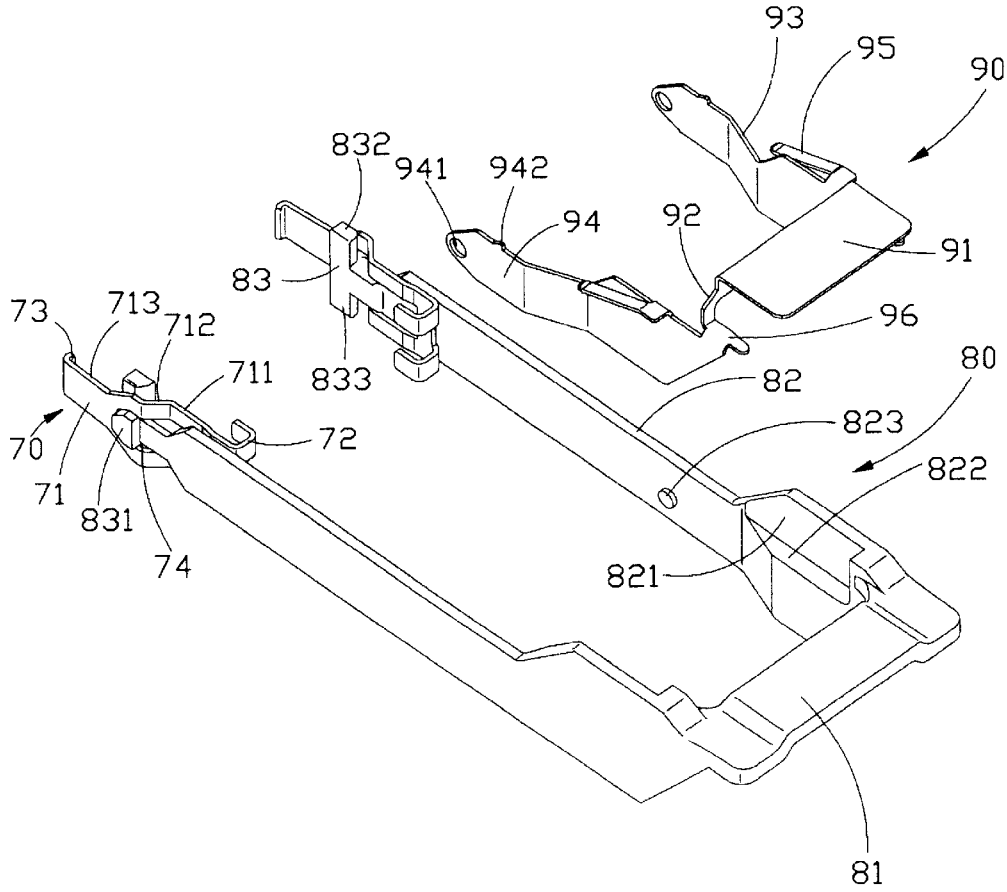
FIG. 4 is an enlarged perspective view of a metal locker, a pull tab and a pair of latch springs shown in FIG. 1 from a bottom aspect.

Referring to FIG. 4, each of the latch springs 70 is formed by stamping a metal sheet and has a body portion 71, a U-shaped claw portion 72 formed at a rear end of the body portion 71, and an L-shaped claw portion 73 formed at a front end of the body portion 71. An elongated cutout 74 is defined in the body portion 71 in a front-to-rear direction. The body portion 71 comprises a rear portion 711, a sloping portion 712 inclined outwardly from the rear portion 711, and a front portion 713 extending inwardly from the sloping portion 712.

The pull tab 80 comprises an operation portion 81, a pair of arms 82 extending forwardly from opposite sides of the operation portion 81, and a pair of latch releasing portions 83 formed at front ends of the arms 82, respectively. Each arm 82 define a cutout 821 at inner side thereof and adjacent to the operation portion 81, and has an stopper plane 822 at a bottom side of the cutout 821. A pair of pivots 823 projects from inner sides of the pair of arms 82. Each latch releasing portion 83 has upper and lower ends 833, 832, and a protrusion 831 protruding outwardly from an outer face thereof.

The locker 90 is formed by stamping a metal sheet and comprises a pressing portion 91, a pair of connecting portions 92 extending upwardly from lateral sides of a front edge of the pressing portion 91, and a pair of stopper portions 96 extending from top ends of the connecting portions 92 in a direction the same as that of the pressing portion 91. A pair of beams 93 respectively connects with the stopper portions 96 and extends forwards. A pair of spring plates 95 is formed at bottom edges of the beams 93 and is bent upwardly. The beams 93 each have a fitting portion 94 at front end thereof. The fitting portions 94 each define a rotate center 941 at tip ends thereof and form a barb 942 at a bottom edge thereof.

Figure 5:
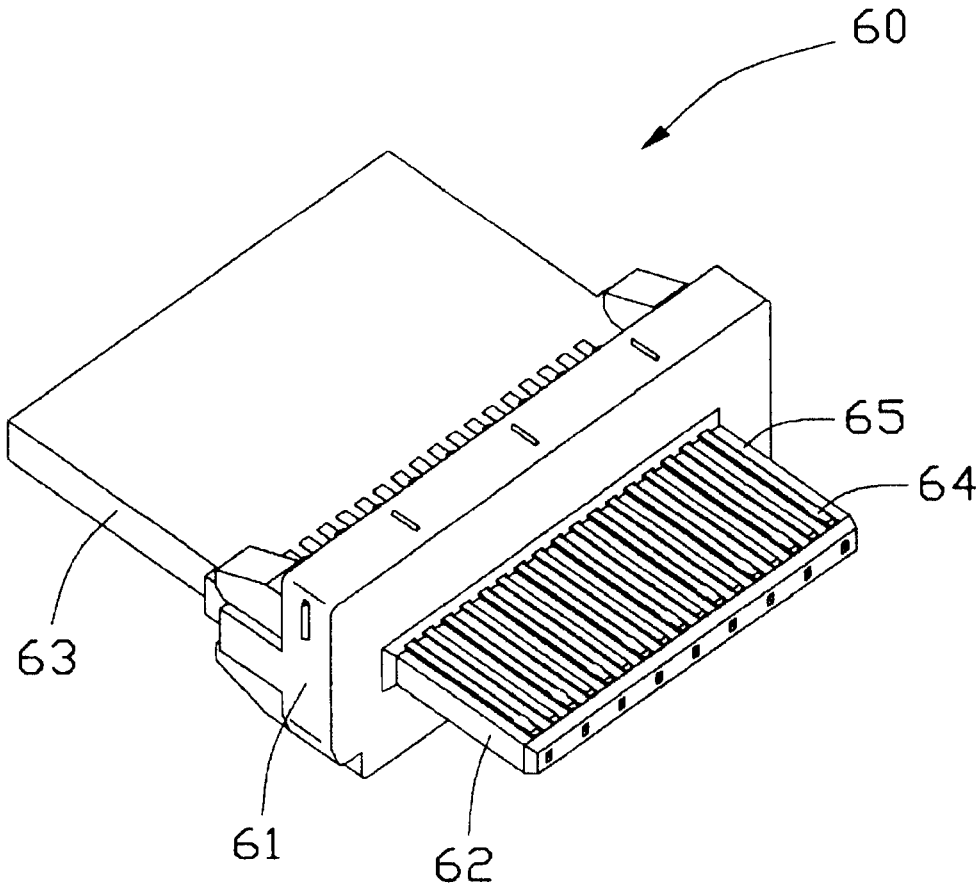
FIG. 5 is an enlarged perspective view of a connector subassembly shown FIG. 1.
Figure 6:
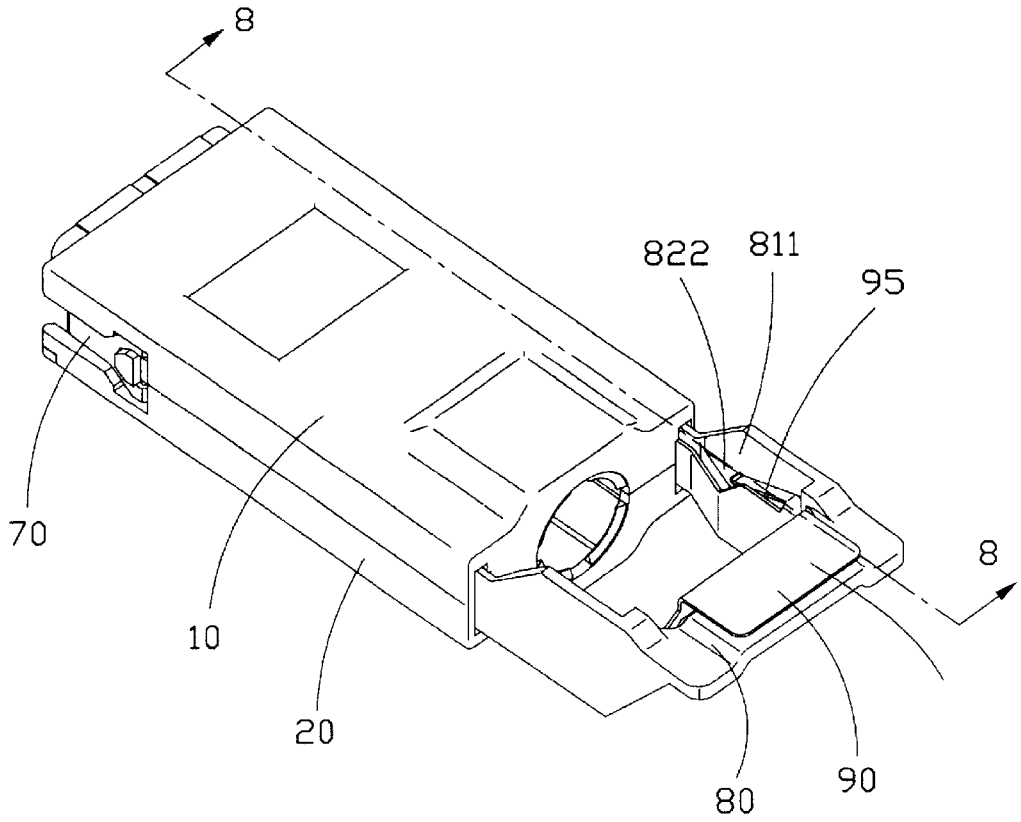
FIG. 6 is an assembled view of the electrical connector shown in FIG. 1 from a bottom aspect.
Figure 7:
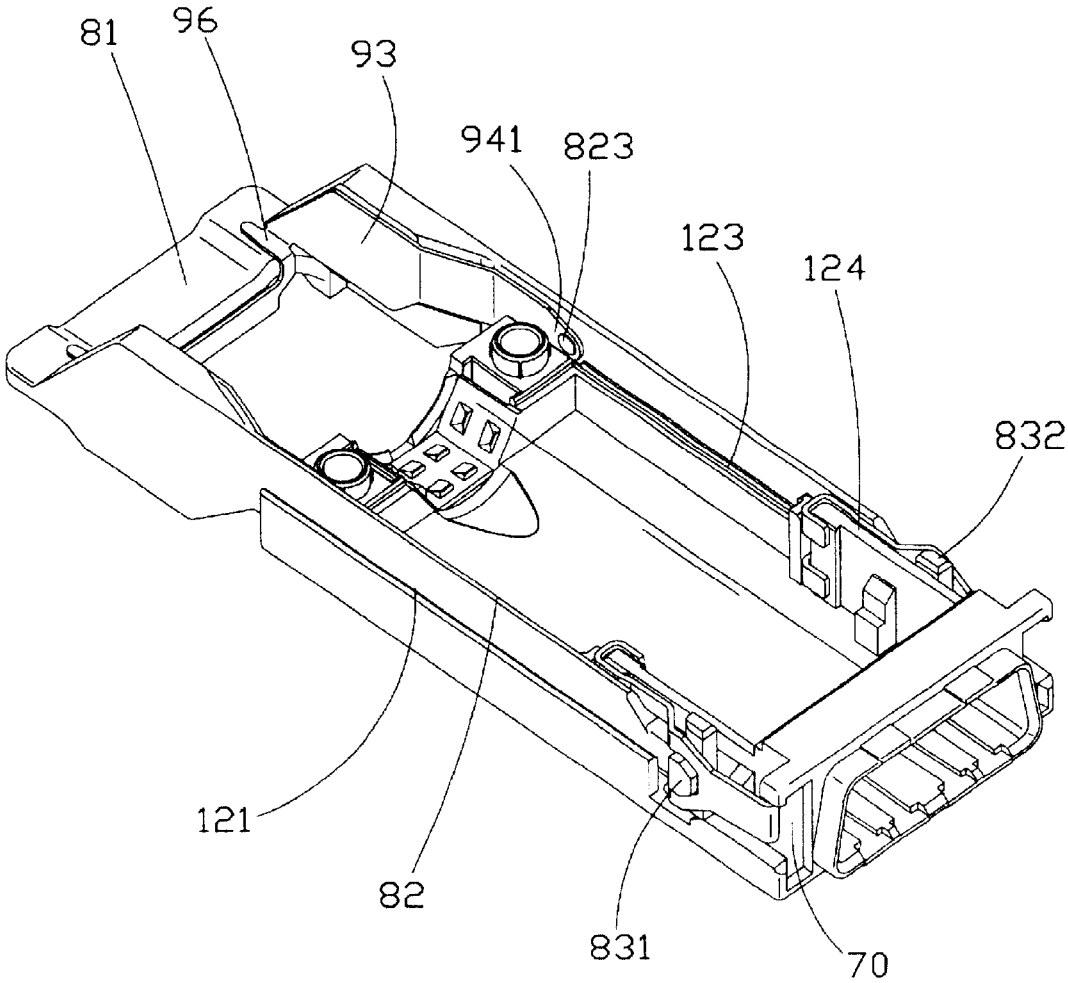
FIG. 7 is a view similar to FIG. 6, from a different aspect and with the cover and the connector sub assembly being removed.

Referring to FIG. 5, the connector subassembly 60 comprises an insulating housing 61, a tongue portion 62 extending forwardly from the housing 61, a printed circuit board (PCB) 63 assembled to a rear side of the housing 61. A plurality of passageways 65 is defined in upper and lower surfaces of the tongue portion 62. A plurality of terminals 64 is received in the passageways 65 of the tongue portion 62 and extends through the housing 61 to electrically connect the PCB 63.

Referring to FIGS. 6–10, in assembly, the connector subassembly 60 is assembled to the base 10 with the tongue portion 62 received in the opening 133. The PCB 63 is received in the base 10 between the two sidewalls 12. The two latch springs 70 are respectively assembled to the pull tab 80 by extending the protrusions 831 into the cutouts 74 from inner faces of the latch springs 70, whereby the latch releasing portions 83 engage with the inner faces of the latch springs 70, respectively. The latch releasing portions 83 are positioned at the inner faces of the front portions 713 and the protrusions 831 are fitted into front portions of the cutouts 74. The locker 90 is assembled to the pull tab 70 with the pressing portions 91 placed beneath the operation portion 81 and the stopper portions 96 abutting against an upper surface of the operating portion 81. The beams 93 are placed at inner sides of the arms 82 and the spring portions 95 are positioned into the cutouts 821 and abut against the stopper planes 822. The rotate centers 941 receive the pivots 823 therein. Then, the latch springs 70 together with the pull tab 80 and the locker 90 are assembled to the base 10. The arms 82 are placed into the channels 121 with the operation portion 81 located in rear of the rear portion 14 of the base 10. The fitting portions 94 are received into the widened portions 1211 of the channels 121 with the barbs 942 abutting against front edges of the stoppers 141. The U-shaped claw portions 72 are received into the slits 125 and engaged with rear ends of the shoulder portions 124 to secure the latch springs 70 to the base 10. The lower ends 832 of the latch releasing portions 83 are placed in the grooves 111 with the protrusions 831 extending into the cutouts 1221. The L-shaped claw portions 73 extend into the engaging spaces 132 for latching with a complementary connector (not shown). The cover 20 is assembled to the base 10 by placing the projections 23 below the pair of engaging ears 131. Then a rear portion of the cover 20 is rotated downwardly about the pair of engaging ears 131 until a bottom face of the cover 20 intimately abuts the engaging face 16 of the base 10. Upper portions of the arms 82 are received in the channels 221 and the upper ends 833 of the latch releasing portions 83 are received into the grooves 212 of the cover 20. The posts 18 are received into the holes 28 with the four ribs 182 engaging with inner surfaces of the holes 28. The first and second openings 17 and 27 together form a cable receiving opening for extension of a cable (not shown) therethrough. Finally, the screws 30 are screwed into the screw holes 181 to securely fasten the cover 20 and the base 10 together, whereby the electrical connector 1 in accordance with the present invention is obtained.

When the complementary connector is mated with the electrical connector 1 of the present invention, the L-shaped claw portions 73 clamp corresponding engaging portions of the complementary connector. When the pull tab 80 is pulled by a rearward force, the barbs 942 are stopped by the stoppers 141 and the pull tab cannot move rearwards. The electrical connector is unmated with the complementary connector by the following operation.

Figure 8:
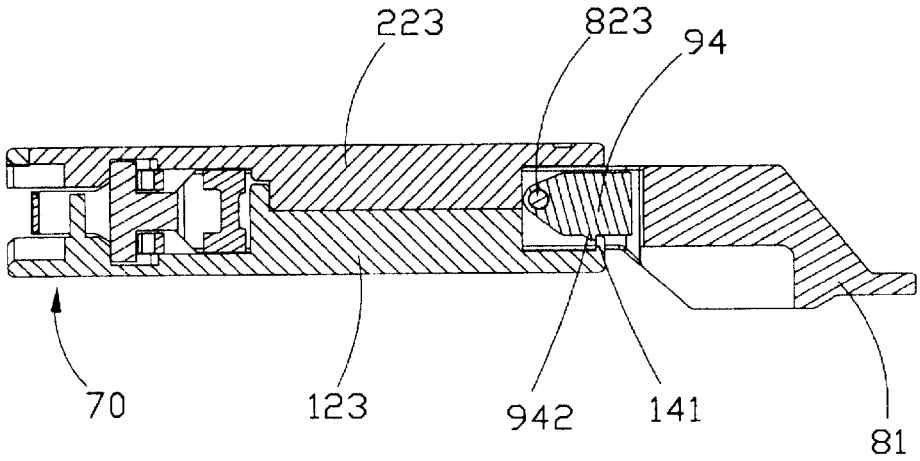
FIG. 8 is a cross-sectional view of FIG. 6, taken along a line 8—8.
Figure 9:
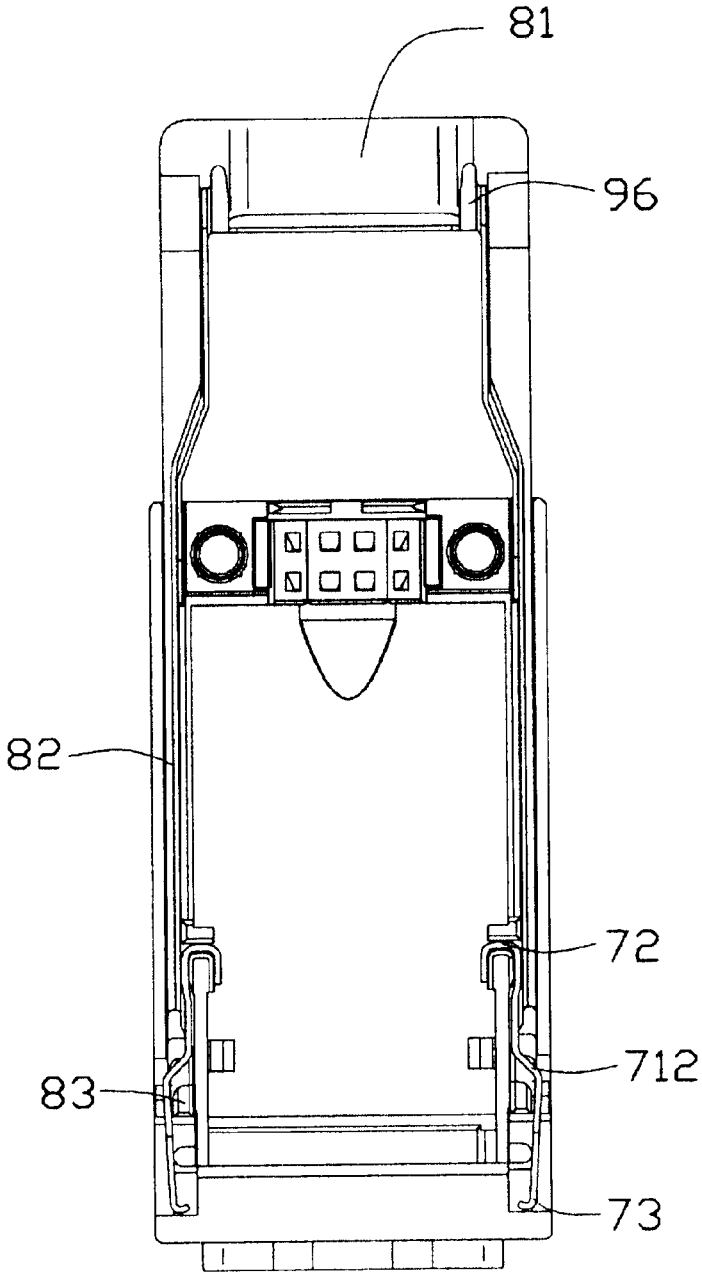
FIG. 9 is a top view of FIG. 7, in which the latch springs are located at a close position.
Figure 10:
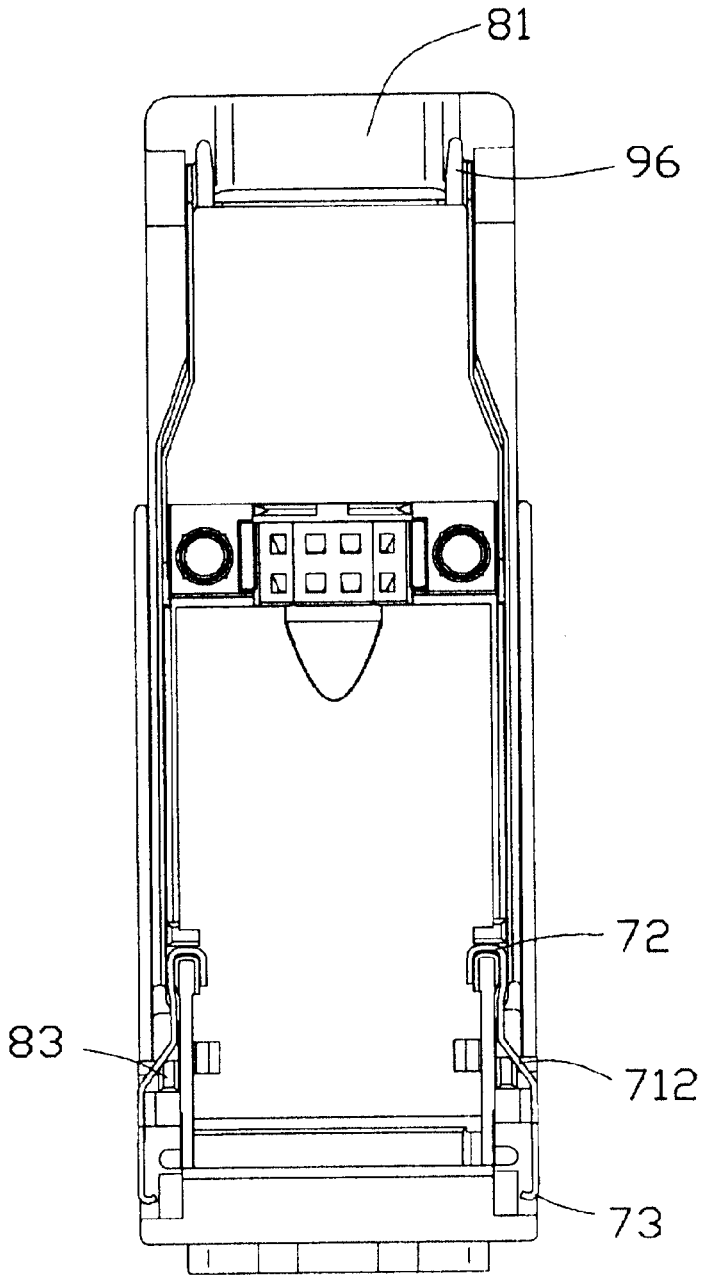
FIG. 10 is a view similar FIG. 9, showing the latch springs being moved to an open position.

An operator presses the pressing portion 91 upwards toward the operating portion 81 to cause the beams 93 to rotate about the pivots 823. The spring plates 95 are elastically deformed by the stopper planes 822 and the barbs 942 move upwardly from the stoppers 141. Then, the operator grips the pressing portion 91 together with the operation portion 81 of the pull tab 80 and pulls them rearwards, whereby the pull tab 80 is moved rearwards. The upper and lower ends 833, 832 slide in the grooves 212, 111 and the protrusions 831 slide in the cutouts 74. When the latch releasing portions 83 come into contact with the sloping portions 712, they exert an outward force on inner faces of the sloping portions 712. The latch springs 70 are elastically deformed and the front portions 713 are pushed outwardly. Thus, the L-shaped claw portions 73 are driven to move out of the engaging portions of the complementary connector. Accordingly, the latch springs 70 no longer latch with the complementary connector, and the electrical connector 1 in accordance with the present invention is ready to be separated from the complementary connector. When the upper and lower ends 833, 832 are moved to rear ends of the grooves 212, 111 and engage with the cover 20 and the base 10, the force pulling the pull tab 80 is transferred into a force pulling the electrical connector 1. Hence, the electrical connector 1 is pulled out from the complementary connector. When the pulling force acting on the pull tab 80 is released, a spring force of the sloping portions 712 of the latch springs 70 is exerted on the latch releasing portions 83 and the spring force pushes the pull tab 80 back to the original position as shown in FIG. 8. When the pressing force on the pressing portion 91 is released, the spring plates 95 revert to their original shape, whereby the beams 93 and accordingly the locker 90 are rotated about the pivots 823 to return to their original position by a spring force of the spring plates 95. It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the discrete pull tab and locker may be integrally formed as one unitary piece wherein such a combo piece performs the pull/press operation to achieve the foolproof function.

What is claimed is:

1. An electrical connector for mating with a complementary connector, comprising:

a base defining a pair of elongated channels each including a stopper in opposite sides of the base;

a cover assembled to the base, the base and the cover together define an enclosure for receiving a connector housing;

a pull tab assembled to the base/cover assembly and having a pair of arms, each arm having a latch releasing portion at a free end thereof;

a pair of latch springs cooperating with the pull tab for latching with the complementary connector, the latch releasing portions driveably connecting with the latch springs, whereby when the latch releasing portions moves the latch springs also moves in a predetermined manner; and a locker having a pressing portion and a pair of locking portions, the locker connecting with the pull tab and the locking portions abutting against stoppers to secure the pull tab on the base where the locker is at a first position;

wherein when the pressing portion is moved to a second position, the locking portions disengage from the stoppers, whereby the pull tab can be moved in a first direction to cause the latch releasing portions to drive the latch springs to move in a direction for separating from the complementary connector; wherein the locker has a pair of beams extending from the pressing portion, the locking portions are formed on edges of the beams; wherein the locker has a pair of spring portions formed on the beams and abutting against the pull tab, the pressing portion moves from the second position to the first position by a spring force of the spring portions; wherein the locker has a stopper portion extending from the pressing portion and in a direction the same as the pressing portion for abutting against an upper surface of the pull tab.

2. The electrical connector as described in claim 1, wherein the locker has a pair of pivots and the arms of the pull tab has a pair of rotate axis, the rotate centers receive the pivots therein, when the pressing portion of the locker is moved to the second position, the beams rotate about the pivots to cause the locking portions to disengage from the stoppers.

3. The electrical connector as described in claim 1, wherein the pull tab has an operation portion, the pressing portion and the stopper portion respectively located at lower and upper sides of the operation portion.

4. The electrical connector as described in claim 1, wherein the pair of elongated channels in opposite sides receive the arms of the pull tab.

5. The electrical connector as described in claim 1, wherein each latch spring has a first claw portion engaging with the respective arm, a second claw portion adapted for latching with the complementary connector, and a sloping portion between the first and second claw portions, the latch springs are outwardly deflectable when the pull tab is moved in the first direction.

* * * * *